US006363703B1

(12) United States Patent
Kolmes

(10) Patent No.: US 6,363,703 B1
(45) Date of Patent: Apr. 2, 2002

(54) WIRE WRAPPED COMPOSITE YARN

(75) Inventor: Nathaniel H. Kolmes, Hickory, NC (US)

(73) Assignee: Supreme Elastic Corporation, Hickory, NC (US)

( * ) Notice: Subject to any disclaimer, the term of this patent is extended or adjusted under 35 U.S.C. 154(b) by 0 days.

(21) Appl. No.: 09/585,003

(22) Filed: Jun. 1, 2000

(51) Int. Cl.[7] ..... D02G 3/02

(52) U.S. Cl. ..... 57/210; 57/211; 57/212; 57/213; 57/214; 57/216; 57/218; 57/220; 57/222; 57/224; 57/231; 57/232

(58) Field of Search ..... 57/210, 211, 212, 57/213, 214, 216, 218, 220, 222, 224, 231, 232

(56) References Cited

U.S. PATENT DOCUMENTS

| | | | | |
|---|---|---|---|---|
| 1,574,004 A | | 2/1926 | Ryder | |
| 2,609,653 A | | 9/1952 | Peterson | 57/145 |
| 3,336,744 A | | 8/1967 | Peene | 57/145 |
| 4,202,382 A | | 5/1980 | Westhead | 57/210 |
| 4,290,260 A | | 9/1981 | Wasserman | 57/210 |
| 4,313,998 A | | 2/1982 | Pivot et al. | 428/222 |
| 4,350,731 A | | 9/1982 | Siracusano | 428/234 |
| 4,384,449 A | | 5/1983 | Brynes, Sr. et al. | 57/210 |
| 4,458,475 A | | 7/1984 | Schmit et al. | 57/243 |
| 4,470,251 A | | 9/1984 | Bettcher | 57/230 |
| 4,750,324 A | | 6/1988 | Tochacek et al. | 57/210 |
| 4,777,789 A | | 10/1988 | Kolmes et al. | 57/210 |
| 4,838,017 A | | 6/1989 | Kolmes et al. | 57/210 |
| 4,936,085 A | | 6/1990 | Kolmes et al. | 57/229 |
| 5,119,512 A | | 6/1992 | Dunbar et al. | 2/167 |
| B15,177,948 A | | 4/1995 | Kolmes et al. | 57/229 |
| 5,423,168 A | * | 6/1995 | Kolmes et al. | 57/229 |
| 5,597,641 A | | 1/1997 | Suematsu et al. | 428/195 |
| 5,628,172 A | | 5/1997 | Kolmes et al. | 57/210 |
| 5,632,137 A | | 5/1997 | Kolmes et al. | 57/212 |
| 5,644,907 A | | 7/1997 | Kolmes et al. | 57/230 |
| 5,655,358 A | | 8/1997 | Kolmes | 57/212 |
| 5,845,476 A | | 12/1998 | Kolmes | 57/229 |

* cited by examiner

*Primary Examiner*—John J. Calvert
*Assistant Examiner*—Shaun R Hurley
(74) *Attorney, Agent, or Firm*—Womble Carlyle, Sudrigce & Rice LLP; C. Robert Rhodes

(57) ABSTRACT

A composite cut-resistant yarn having a fiberglass and wire component a fiberglass core strand having a denier of between about 100 and about 1200 at least a first wire strand wrapped the fiberglass core strand in a first wire strand direction and at least a first non-metallic non-high performance fiber cover strand wrapped around the first wire strand in a first cover strand direction. The yarn does not include high performance constituents, yet is comparable in cut-resistance characteristics.

18 Claims, 2 Drawing Sheets

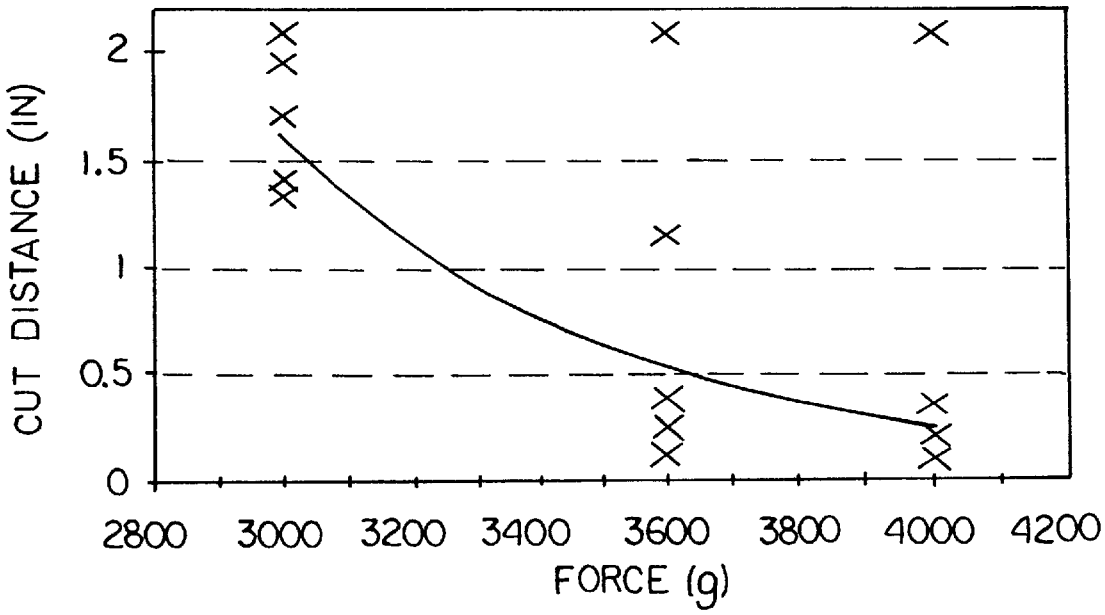
FIG. 5
FIG. 6
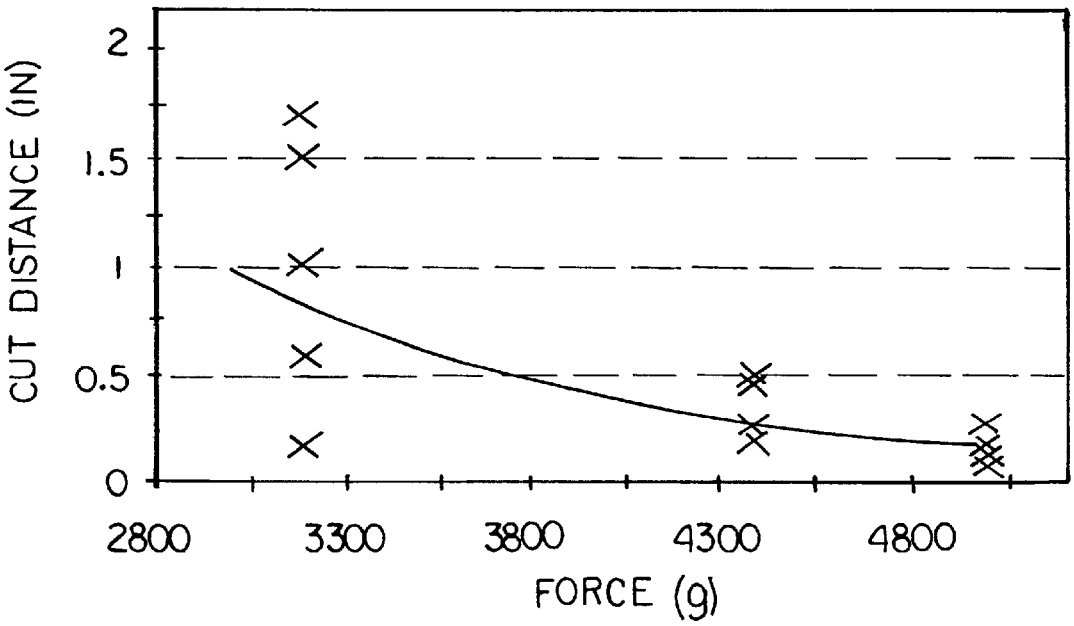

WIRE WRAPPED COMPOSITE YARN

FIELD OF THE INVENTION

The present invention relates generally to yarns, fabrics and protective garments knitted of such yarns. More particularly, the present invention relates to a cut-resistant composite yarn construction which provides effective cut resistance for a protective garment without the use of expensive high performance fibers.

DESCRIPTION OF THE PRIOR ART

In many industries, it is desirable to provide protective garments, particularly gloves, to protect employees from being cut. Ideally, such garments should provide an acceptable amount of cut resistance while possessing suitable flexibility and durability. To this point knit garments having these qualities have been constructed from yarns that include "high performance" fibers to achieve enhanced cut resistant performance. These yarns are constructed using wrapping technique wherein in a core comprising of a single or multiple strands is wrapped with one or more additional strands. Either the core or the wrap strands may include strands comprised of a high performance fiber. Typical of these include the cut resistant yarn disclosed in U.S. Pat. Nos. 4,777,789; 4,838,017 and 5,119,512. These patents disclose the use of well-known "high performance" fibers which, as used herein, means fibers such as extended chain polyethylene (Spectra® brand fiber by Allied) or aramid (Kevlar® brand fiber by DuPont).

The use of these high performance fibers to make cut-resistant composite yarns and garments has not come without certain disadvantages. First, articles made from these high performance fibers may be stiff and, particularly in the case of protective gloves, may cause the wearer to lose a certain amount of tactile sense and feedback. This lose of sensitivity can be important for workers in the meat processing industry.

Another potential drawback to the use of high performance fibers is their cost. For example, the unit length cost for high performance fiber easily may be several times that of the next most expensive component of a composite, cut-resistant yarn. It would be very desirable to substantially reduce or eliminate the high performance fiber content of a cut-resistant composite yarn.

There remains a need for a cut-resistant yarn construction offering an effective level of cut resistance performance at a cost savings compared to composite yarns that include high performance fibers.

SUMMARY OF THE INVENTION

The present invention relates to a cut-resistant composite yarn that includes a core of a fiberglass strand(s) wrapped with one or two fine metal strands, which combination provides the cut-resistant properties of the yarn. The fiberglass core and wire wrap is covered by one or two core strands of a conventional material. It has been discovered that the combination of a wire strand or strands wrapped around a soft fiberglass core provides a cut resistance performance that rivals that of cut-resistant yarns having the more expensive high performance fibers. Even if the cut resistance performance of the yarn of the present invention does not match exactly that of a cut-resistant yarn including a high performance fiber, the performance levels are acceptable. Significantly, these acceptable performance levels are achieved at great cost savings because of the elimination of the high performance yarn. Further, the fiberglass core with a single wrap of wire exhibits enhanced flexibility.

More specifically, the yarn of the present invention includes one or two fiberglass core strands having a total denier of between about 100 and about 1200 and at least one wire strand wrapped about the fiberglass core strand. A second wire strand may be wrapped around the first wire strand in a direction of wrapping opposite that of the first wire strand. The wire strands(s) should be no greater than 0.0030 inches in diameter and preferably between 0.0013 and 0.0030 inches. The yarn further includes a non-metallic, non-high performance fiber cover strand of a more conventional material wrapped around the core in a direction of wrap opposite that of the wire strand immediately there beneath. A second non-high performance fiber cover strand may be wrapped around the first cover strand in a direction opposite that of the first cover strand direction. If desired, the composite cut-resistant yarn of the present invention may further include a second fiberglass or wire strand in the core positioned adjacent to the first fiberglass strand.

These and other aspects of the present invention will become apparent to those skilled in the art after a reading of the following description of the preferred embodiments when considered in conjunction with the drawings. It should be understood that both the foregoing general description and the following detailed description are exemplary and explanatory only and are not restrictive of the invention as claimed. The accompanying drawings, which are incorporated in and constitute a part of this specification, illustrate one embodiment of the invention and, together with the description, serve to explain the principles of the invention.

BRIEF DESCRIPTION OF THE DRAWINGS

The various benefits and advantages of the present invention will be more apparent upon reading the following detailed description of the invention taken in conjunction with the drawings.

In the drawings, wherein like reference numbers identify a corresponding component:

FIG. 5 is a graph illustrating the results of testing the cut resistance of a yarn constructed according to the present invention; and FIG. 6 is a graph illustrating the results of testing the cut resistance of a yarn similar to that used in the test of FIG. 5, except utilizing high performance yarn in the cover.

DETAILED DESCRIPTION OF THE PREFERRED EMBODIMENTS

Figure 1:
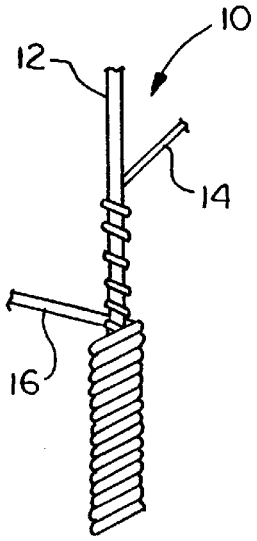
FIG. 1 is a schematic illustration of a preferred embodiment of the cut resistant yarn of the present invention including one core strand, one wire strand, and one cover strand.
Figure 2:
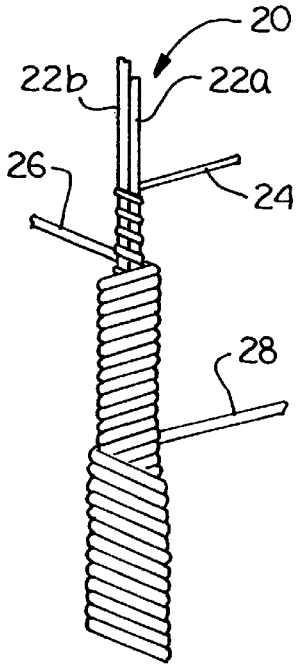
FIG. 2 is a schematic illustration of an alternative embodiment of the present invention including two core strands, one wire strand and two cover strands.
Figure 3:
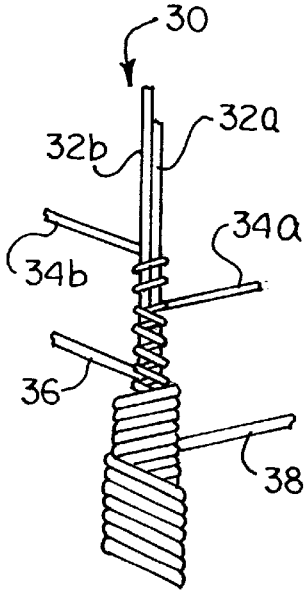
FIG. 3 is a schematic illustration of another alternative embodiment of the present invention including two core strands, two wire wrap strands and two cover strands.

The present invention is directed to the concept of a cut-resistant composite yarn having cut-resistant properties comparable to yarns with high performance fiber, yet which have no expensive high performance fibers therein. In general the yarns are formed of a core containing fiberglass, an inner wrap of wire, and a cover of conventional yarn. Anyone, two, or all of the core, wire wrap, and cover may include two strands. FIGS. 1–3 are exemplary of the various embodiments.

Turning to FIG. 1, there is illustrated one embodiment of a composite cut resistant yarn 10 which included includes a core formed of a fiberglass strand 12 that is wrapped with a wire strand 14. The cut resistant yarn 10 further includes a non-metallic, non-performance fiber cover strand 16 wrapped around the wire strand. Desirably, the cover strand 16 is wrapped in a direction opposite that of the wire strand 14.

Turning now to FIG. 2, an alternative embodiment of a cut resistant yarn 20 includes first and second core strands 22*a*, 22*b*. At least one of the strands is fiberglass but the other may be fiberglass, wire, or a conventional yarn, but not a high performance yarn. The strands are positioned adjacent to each other and, in this preferred embodiment, are positioned parallel to each other. The term "adjacent" as used herein also contemplates side-by-side relationships other than parallel such as twisted or one wrapped around the other. The core strands 22*a*, 22*b* are wrapped by a wire strand 24. A first non-metallic, non-high performance fiber cover strand 26 is wrapped around the wire strand 24 that is opposite that of the wire strand 24. This embodiment may further include a second non-metallic, non-high performance fiber cover strand wrapped around the first cover strand 26 in a direction opposite to that of the first cover strand 26.

Referring now to FIG. 3, another preferred embodiment of the composite cut-resistant yarn 30 includes first and second core strands 32*a*, 32*b*, at least one of which is fiberglass, wrapped by first and second wire strands 34*a*, 34*b* in opposing directions. This embodiment is further provided with first and second non-metallic, non-high performance fiber cover strands 36, 38 which are wrapped in opposing directions around the wire strands 34*a*, 34*b*.

The wire used in the practice of the present invention desirably has a diameter of between about 0.0013 and about 0.0030 inch. Where two wires are used, they should be of a diameter at the lower end of the range, e.g. about 0.0013 to about 0.0020. In each instance, the wire strand is wrapped about the fiberglass core strand at a rate of between about 6 and about 13 turns per inch. Desirably, the non-metallic, non-high performance fiber cover strands are also wrapped about the wire strand or strands at a rate of between about 6 and about 13 turns per inch The wire strands of the present invention desirably are formed from an annealed stainless steel with the particular diameter of wire selected from the ranges specified above based on the desired properties and end use of the composite yarn.

The first cover strand and, if used, the second cover strand are comprised of a non-metallic, non-high performance fiber. The strands may be provided in either spun or filament form within a denier range of about 100 to about 1200. Suitable materials for the cover strands include polyester, polyester/cotton blends, acrylic, various types of nylon, wool and cotton. The choice of a particular material for the cover strand or strands will vary depending on the end use of the composite yarn and the physical characteristics (appearance, feel, etc.) desired for the yarn.

The fiberglass strand (or strands) in the core may be either E-glass or S-glass of either continuous multi-filament filament or spun. The practice of the present invention contemplates using several different sizes of commonly available fiberglass strand, as illustrated in Table 1 below:

TABLE 1

| Fiberglass Size | Approximate Denier |
|---|---|
| G-450 | 99.21 |
| D-225 | 198.0 |
| G-150 | 297.6 |
| G-75 | 595.27 |
| G-50 | 892.90 |
| G-37 | 1206.62 |

The size designations in the Table are well known in the art to specify fiberglass strands.

These fiberglass strands may be used singly or in combination depending on the particular application for the finished article. By way of non-limiting example, if a total denier of about 200 is desired for the fiberglass component of the core, either a single D-225or two substantially parallel G-450 strands may be used. It is also possible to combine a fiberglass and wire strand in the core (Example 3). In a preferred embodiment either a single strand or a combination of strands will have a denier of about between 200 and about 1200.

It should be understood that the table above illustrates currently available fiberglass strand sizes. The practice of the present invention contemplates the use of other fiberglass strand sizes as they become available in the market or as found to be suitable for particular applications.

Suitable types of fiberglass fiber are manufactured by Coming and by PPG. The fibers have the desirable properties of relatively high tenacity, of about 12 to about 20 grams per denier, resistance to most acids and alkalis, being unaffected by bleaches and solvents, resistance to environmental conditions such as mildew and sunlight, and high resistance to abrasion and to aging.

Preferably the overall denier of the yarn of the present invention to include the fiberglass strand(s), the wire strand (s), the bottom cover, and the top cover is between about 500 denier and about 5000 denier. Further the combined mill weight of the fiberglass and wire components should be between 40% and 70% of the composite yarn.

By way of non-limiting example, yarn constructions utilizing the principles of the present invention are illustrated as Examples 1–11 in Table 2 below. Examples 11 through 14 are included for comparative tests and will be explained hereinafter. The nomenclature "_X" refers to the number of strands of a particular composite yarn component used. Where two items of a particular component are used, they are wrapped in opposing first and second directions.

TABLE 2

| Exp | Core | Wire Diam | 1st Cover | 2nd Cover |
|---|---|---|---|---|
| 1 | G-75 | 0.0016 | Polyester 500 Denier | |
| 2 | G-37 | 0.0016 | Nylon 1000 denier | |
| 3 | G-450 0.0016 wire | 0.0016 | Polyester 150 Denier | Polyester 150 Denier |
| 4 | G-75 | 0.0030 | Polyester 500 denier | |
| 5 | G-37 | 0.0030 | Nylon 1000 denier | |

TABLE 2-continued

| Exp | Core | Wire Diam | 1st Cover | 2nd Cover |
|---|---|---|---|---|
| 6 | G-150 | 0.0016 | Cotton 30/1 | |
| 7 | G-37 | 2X-0.0016 | Polyester 500 Denier | Polyester 500 Denier |
| 8 | G-75 | 2X-0.0020 | Polyester 500 Denier | Polyester 500 Denier |
| 9 | G-450 | 2X-0.0016 | Polyester 36/1 Spun | Polyester 150 Denier |
| 10 | G-37 | 2X-0.0016 | Polyester 500 Denier | Nylon 1000 Denier |
| 11 | G-37 | 2X-0.0016 | Spectra Fiber 215 Denier | Spectra Fiber 375 Denier |
| 12 | G-450 | Spectra ® 200 Denier | Polyester 70 Denier | Polyester 70 Denier |
| 13 | G-75 | Spectra ® 650 Denier | Spectra ® 650 Denier | Polyester 1000 Denier |
| 14 | G-37 | Spectra ® 650 Denier | Spectra ® 650 Denier | Polyester 1000 Denier |

The Examples using a smaller denier core and cover such as Examples 1,3,4, 6 and 9 would be knit using a 10 gauge or similar knitting machine. The Examples using larger denier core and cover, such as Examples 2,5, 7 and 8–10 would be knit using a 7 gauge or similarly sized knitting machine.

The yarn of the present invention may be manufactured on standard yarn-making equipment. If the yarn will be provided with the cover layers, preferably the fiberglass strand is wrapped with the wire cover strand in a first step. Next, the bottom and, if used, top cover strands are added in a second operation on a separate machine. Other procedures may be used as will be readily apparent to one of ordinary skill.

The yarn of the present invention has several advantages over the non-metallic cut resistant yarns described herein above. The fiberglass strand and the cover strand mutually benefit each other. The fiberglass component acts as a support for the cut/abrasion resistant wire strand. Properties of the resulting yarn may be varied by varying the diameter and the rate of wrap (turns per inch) of the wire strand about the fiberglass strand.

The cut resistance performance of the yarn of the present invention is illustrated in FIGS. 5 and 6 which compare the performance of the yarn constructed according to the present invention (without a high performance fiber) to a similar structure that includes a high performance fiber. Testing was conducted using ASTM test procedure F 1790-97. FIG. 5 shows the test results for a cut-resistant yarn constructed according to Example 10 described in Table 2 above. FIG. 6 illustrates the test results for a yarn constructed according to Example 11 in Table 2 above. Example 11 is comprised of the same fiberglass core and wire wraps as that in Example 10 with the substitution of 375 denier and 200 denier Spectra fiber for the first and second covers respectively. For this ASTM test the reference force is the mass required for the cutting edge of the test apparatus to travel one inch and initiate "cut through" in the material being tested. This quantity is determined by interpolation of the test results in FIGS. 5 and 6. For the yarn of the present invention (FIG. 5) this weight was 3,249 grams. For the yarn incorporating the high performance fiber in the cover strands (FIG. 6), this value was 3,004 grams. Thus, the yarn of the present invention provides a comparable cut resistance performance of a high performance fiber yarn at a significant cost savings because of the elimination of the high performance fiber.

Additional cut resistance data collected using the ASTM test described above are summarized in Table 3 below. Each of examples 12–14 is a commercially available cut resistant composite yarn that includes a Spectra® fiber/fiberglass combination. The Spectra® fiber core strand is wrapped around the fiberglass core strand in Examples 12 and 13. The Spectra(® fiber core strand is parallel to the fiberglass core strand in Example 14.

TABLE 3

| | Exp 10 | Exp 11 | Exp 12 | Exp 13 | Exp 14 |
|---|---|---|---|---|---|
| Cut Through Force | 3249 | 3004 | 2017 | 3251 | 3386 |

Examples 12–14 show steadily improving cut-resistance performance results as the amount of high performance fiber and the size of the fiberglass core strand are increased. Surprisingly, the yarn of the present invention (Example 10) compares favorably with each of the examples that include a high performance fiber. The test results show that the comparatively low-cost wire/fiberglass combination provides a cut-resistance performance that is comparable to yarns containing a high performance fiber.

Figure 4:
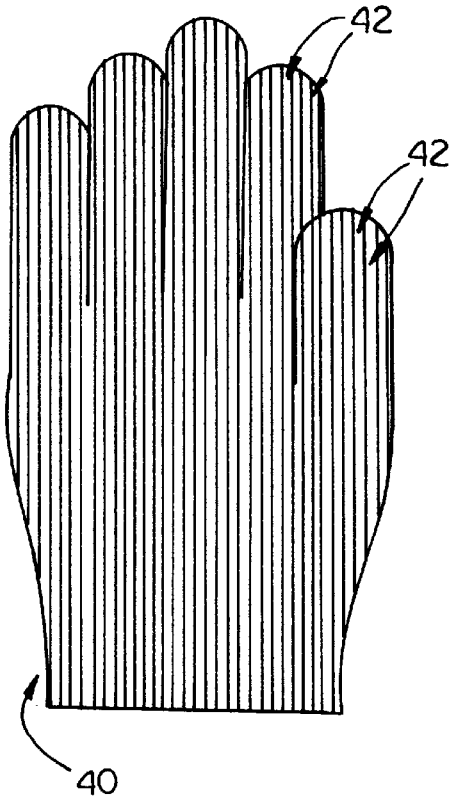
FIG. 4 is a schematic illustration of a glove constructed using the yarn of the present invention.

Turning to FIG. 4, a cut and abrasion resistant glove 40 according to the present invention is illustrated. The glove incorporates finger stalls 42 for each of the wearer's fingers. The cut-resistant yarn may be incorporated into a variety of other types of cut resistance garments and articles to include arm shields, aprons or jackets.

Although the present invention has been described with preferred embodiments, it is to be understood that modifications and variations may be utilized without departing from the spirit and scope of this invention, as those skilled in the art would readily understand. Such modifications and variations are considered to be within the purview and scope of the appended claims and their equivalents.

What is claimed is:

1. A composite cut-resistant yarn comprising:

a. a core including at least one fiberglass strand having a denier of between about 100 and about 1200;

b. at least one wire strand having a diameter of between about 0.0013 inch and about 0.0030 inch and being wrapped around said fiberglass core strand;

c. at least one non-metallic non-high performance cover strand wrapped around said core and wire strand, said cover strand being formed of material selected from the group consisting essentially of polyester, polyester/cotton blends, nylon, acrylic, wool, and cotton.

2. The cut-resistant yarn of claim 1 further comprising a second wire strand wrapped around said at least one wire strand in a second direction opposite that of said at least one wire strand direction.

3. The cut-resistant yarn of claim 1 wherein said at least one wire strand has a diameter between about 0.0013 inch and 0.0020 inch.

4. The cut-resistant yarn of claim 1 further comprising a second non-metallic, non-high performance cover strand wrapped around said at least one cover strand in a second direction opposite that of said at least one cover strand direction, said second non-metallic, non high performance cover strand being selected from the group consisting essentially of polyester, polyester/cotton blends, nylon, acrylic, wool, and cotton.

5. The cut-resistant yarn of claim 1 further comprising a second fiberglass strand.

6. The cut resistant yarn of claim 1 wherein said core further includes a strand of wire adjacent said fiberglass strand.

7. The cut resistant yarn of claim 1 wherein the combined weight of the fiberglass and wire amount to about 40% to about 70% of the composite yarn.

8. The cut-resistant yarn of claim 1 wherein said at least one wire strand is wrapped around said fiberglass core strand at a rate of between about 6 and about 13 turns per inch.

9. The composite yarn of claim 1 wherein said at least one first non-metallic non-high performance fiber cover strand is wrapped at a rate of between about 6 and about 13 turns per inch.

10. The composite yarn of claim 1 wherein said at least one non-metallic non-high performance fiber cover strand has a denier of between about 100 and about 1200.

11. A composite cut-resistant yarn comprising:

a. a core including at least one fiberglass strand having a denier of between about 100 and about 1200.

b. two ends of wire strand, each having a diameter of between about 0.0013 inch and about 0.0020 inch and being wrapped around said core, one of said wire strands being wrapped in one direction and the other strand being wrapped in the opposite direction;

c. two non-metallic, non-high performance cover strands wrapped around said core and wire strands, said cover strands being formed of material selected from the group consisting essentially of polyester, polyester/cotton blends, nylon, acrylic, wool and cotton.

12. The composite cut-resistant yarn of claim 11 wherein said core comprises a fiberglass strand having a denier of approximately 1200, said wire strands have a diameter of approximately 0.0016, and said non-metallic, non-high performance cover strands are formed of approximately 500 denier polyester.

13. The composite cut-resistant yarn of claim 11 wherein said core comprises a fiberglass strand having a denier of approximately 600, said wire strands have a diameter of approximately 0.0020, and said non-metallic, non-high performance cover strands are formed of approximately 500 denier polyester.

14. The composite yarn according to claim 11 wherein the fiberglass strand of the core has a denier of approximately 100, said wire strands have a diameter of approximately 0.0016.

a. one of said cover strands is formed of 36/1 spun polyester and the other cover strand is formed of 150 denier polyester.

15. A cut and abrasion resistant glove formed primarily of a composite cut-resistant yarn comprising:

a. a core including at least one fiberglass strand having a denier of between about 100 and about 1200.

b. two ends of wire strand, each having a diameter of between about 0.0013 inch and about 0.0020 inch and being wrapped around said core, one of said wire strands being wrapped in one direction and the other strand being wrapped in the opposite direction;

c. two non-metallic, non-high performance cover strands wrapped around said core and wire strands, said cover strands being formed of material selected from the group consisting essentially of polyester, polyester/cotton blends, nylon, acrylic, wool and cotton.

16. The cut and abrasion-resistant groove according to claim 15 wherein said core comprises a fiberglass strand having a denier of approximately 1,200, said wire strands have a diameter of approximately 0.0016 inches, and said non-metallic, non-high performance cover strands are formed of approximately 500 denier polyester.

17. The cut and abrasion-resistant glove of claim 15 wherein said core comprises a fiberglass strand having a denier of approximately 600, said wire strands have a diameter of approximately 0.0020 inches, and said non-metallic, non-high performance cover strands are formed of approximately 500 denier polyester.

18. The cut and abrasion-resistant glove of claim 15 wherein the fiberglass strand of the core has a denier of approximately 100, said wire strands have a diameter of approximately 0.0016, and said non-metallic, non-high performance cover strands are formed of approximately 500 denier polyester.

* * * * *

UNITED STATES PATENT AND TRADEMARK OFFICE

CERTIFICATE OF CORRECTION

PATENT NO. : 6,363,703 B1
DATED : April 2, 2002
INVENTOR(S) : Nathaniel H. Kolmes It is certified that error appears in the above-identified patent and that said Letters Patent is hereby corrected as shown below:

Column 8,
Line 22, the fifth word "groove" should read -- glove --.

Signed and Sealed this

Twenty-fifth Day of June, 2002

*Attest:*

*Attesting Officer*

JAMES E. ROGAN
*Director of the United States Patent and Trademark Office*